United States Patent [19]

Slaton

[11] 4,377,014

[45] Mar. 22, 1983

[54] PAIL WASHING MACHINE

[76] Inventor: Hugh M. Slaton, Rte. 1, Box 193, Hogansville, Ga. 30230

[21] Appl. No.: 241,842

[22] Filed: Mar. 9, 1981

[51] Int. Cl.[3] ..... A46B 13/02

[52] U.S. Cl. ..... 15/56; 15/58

[58] Field of Search ..... 15/56, 57, 58, 70, 75, 15/101, 59, 71

[56] References Cited

U.S. PATENT DOCUMENTS

| | | | |
|---|---|---|---|
| 2,454,924 | 11/1948 | Hurst | 15/57 |
| 2,628,378 | 2/1953 | Gilbert et al. | 15/58 |
| 2,685,096 | 8/1954 | Kaye | 15/56 |
| 2,794,195 | 6/1957 | Kaye | 15/57 |
| 2,866,212 | 12/1958 | Peterson . | |
| 2,915,766 | 12/1959 | White et al. . | |
| 3,044,092 | 7/1962 | Fox et al. | 15/75 |
| 3,134,202 | 5/1964 | Hoefler . | |
| 3,435,479 | 4/1969 | Gibson, Sr. . | |
| 3,680,165 | 8/1972 | Garst et al. . | |
| 4,125,087 | 11/1978 | Ronning . | |

*Primary Examiner*—Edward L. Roberts

*Attorney, Agent, or Firm*—Newton, Hopkins & Ormsby

[57] ABSTRACT

Lubricant pails are quickly washed and dried during an automatic machine operating cycle which is initiated by manual placement of each pail on a holding mandrel and simultaneous operation of an adjacent limit switch. Mandrel and pail rotation are initiated and a rotating brush is moved into engagement with the exterior of the rotating pail while cleaning solvent is delivered onto the pail throughout its length. The brush cleaning cycle is followed by a solvent rinse cycle, which in turn is followed by a blown air drying cycle, after which the clean pail is ejected from the mandrel by positive air pressure. The several cycles are timer controlled. In a modification, closed end pails are laterally loaded on a roller bed.

19 Claims, 10 Drawing Figures

PAIL WASHING MACHINE

BACKGROUND OF THE INVENTION

The objective of the invention is to provide a practical, economical, fast and convenient machine for washing the exteriors of five gallon plastic lubricant pails and the like. More particularly, in accordance with the invention, each pail is placed manually onto a pail supporting mandrel of the machine, and this results in operating a limit switch near the mandrel having a switch actuator in the path of movement of each pail. The tripping of the limit switch initiates a completely automatic operating cycle of the machine which, in about twenty seconds, brush washes the exterior of the pail with a grease and paint solvent, rinses the exterior of the pail with solvent, dries the pail with blown air, and ejects the pail from the mandrel while terminating the operational cycle and resetting the machine for its next cycle initiated by the placement of the next pail on the mandrel.

In carrying out the rapid, efficient and automatic pail cleaning operation, the machine utilizes a simplified system of solvent and air control valves which are electrically operated through a coacting arrangement of electrical timers and associated relays. A solvent pump, vacuum air pump and an existing compressed air line are included in the system which also includes an exhaust system for pollutants.

While various power-operated cleaning machines for containers including machines having rotating brushes are known in the prior art, no such known machine exists for the purpose contemplated under this invention, and no known machine possesses the speed, efficiency and convenience of this invention or the simplicity and comparative economy of the invention. Therefore, it is thought that the invention involves significant improvements over the prior art which will be more apparent during the course of the following detailed description.

DETAILED DESCRIPTION

Figure 1:
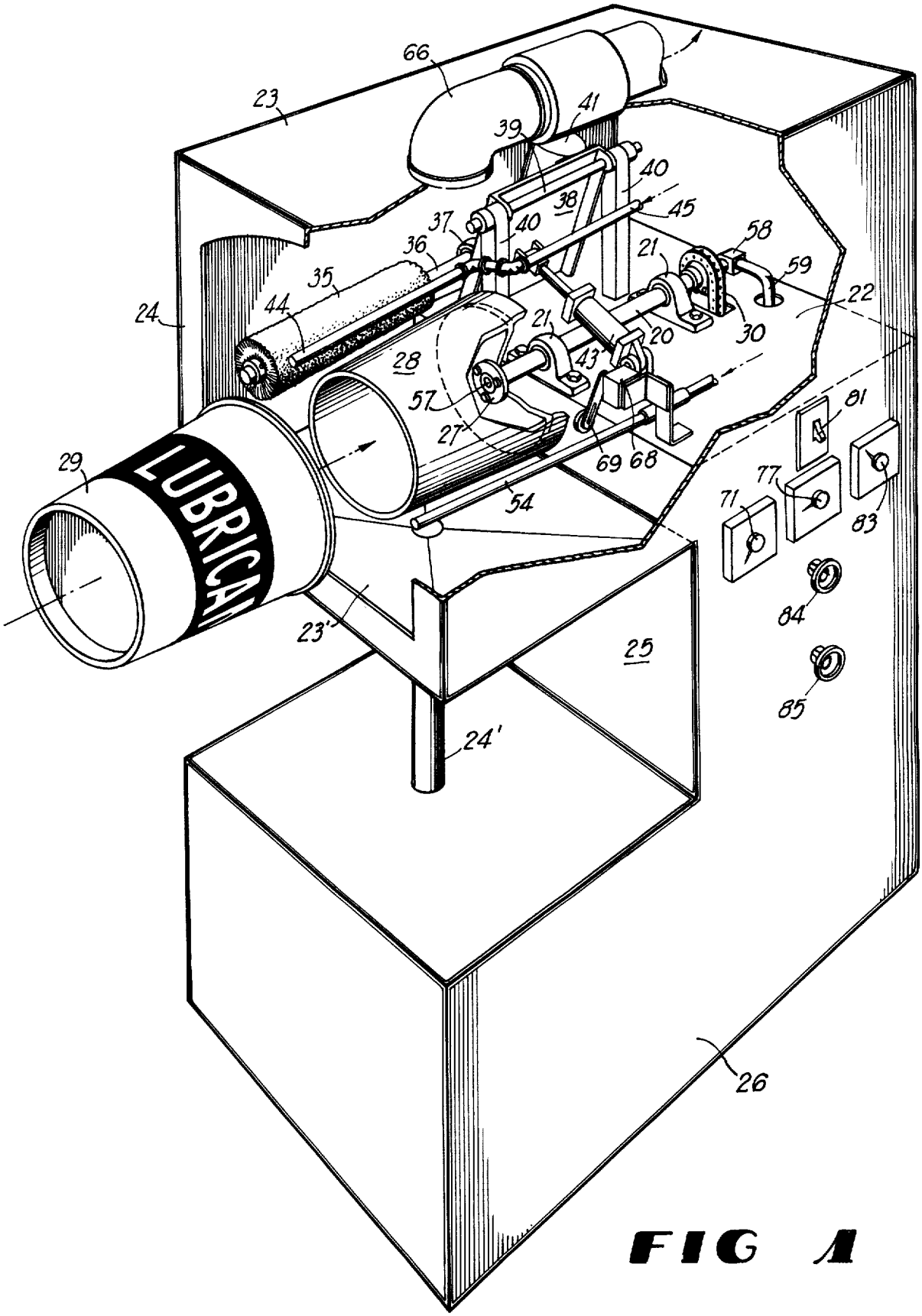
FIG. 1 is a perspective view, partly broken away, of a pail washing machine according to the invention.

Referring to the drawings in detail wherein like numerals designate like parts, a pail washing machine is illustrated in which a hollow, horizontal mandrel drive shaft 20 is supported by spaced bearings 21 on an elevated platform 22 forming part of an upper machine housing 23 having a frontal opening 24. The machine housing also includes a rear vertical portion 25 atop and rising from a lower housing portion 26.

The forward end of rotary shaft 20 is coupled through a driving head 27 with an approximately cylindrical slightly tapered mandrel 28 adapted to have telescopically placed thereon manually pails to be washed, such as the plastic lubricant pail 29 having one end open. The taper of the mandrel 28 allows it to accept difference sized pails. Mandrel 28 is also adapted to be removeable and replaceable by different sized and tapered mandrels.

The shaft 20 is driven in rotation by chain gearing 30 rising through the housing section 25 and coupled with the output shaft 31 of a speed reducer 32, whose input shaft is coupled with additional gearing 33 driven by a mandrel drive motor 34 at the bottom of housing section 25.

A cylindrical pail cleaning brush 35 of sufficient length to contact each pail 29 on its exterior throughout its entire length is removably supported on a horizontal rotary shaft 36 spaced from and roughly parallel to the mandrel drive shaft 20. The brush drive shaft 36 is journaled in spaced bearings 37 attached to a vertically swingable support 38 suspended from an elevated horizontal pivot shaft 39 supported by posts 40 attached to platform 22. Brush 35 is adapted to accept spacers to separate different portions of the brush to allow it to scrub around any exterior circumferential ridges which may be present on the pail.

Figure 2:
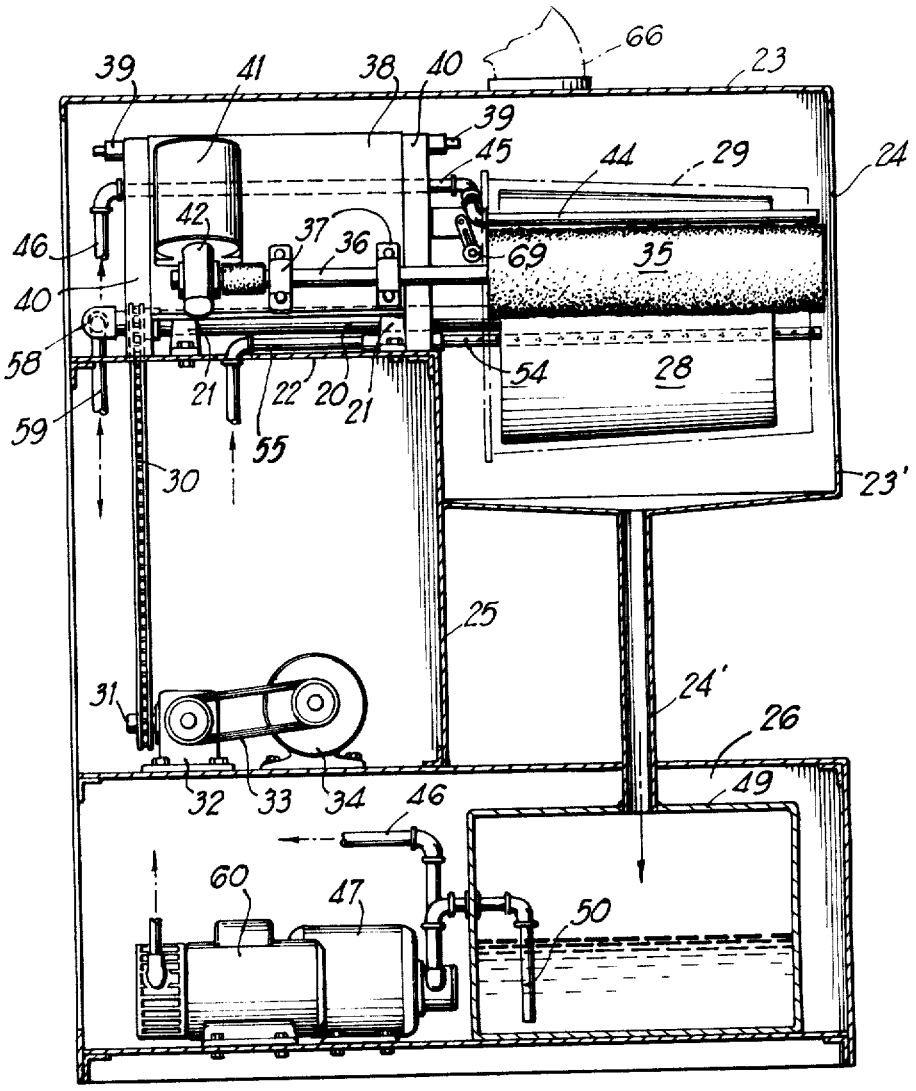
FIG. 2 is a central vertical section through the machine, with parts broken away.

Shaft 36 is driven in rotation by a motor 41 fixed to swingable support 38 and connected with the shaft 36 through a suitable right angle gear drive 42, FIG. 2. The brush 35, its drive shaft 36 and support 38 are swung as a unit toward and away from the mandrel 28 by a pneumatic cylinder 43 coupled between the support 38 and platform 22.

Figure 3:
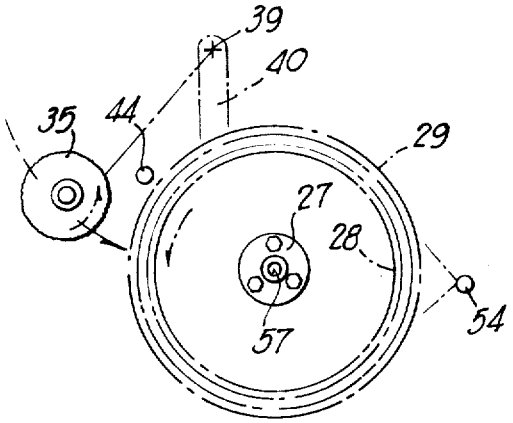
FIGS. 3 and 4 are partly diagrammatic end elevations showing a counter-rotating cleaning brush spaced from and engaging a rotating pail, respectively.
Figure 4:
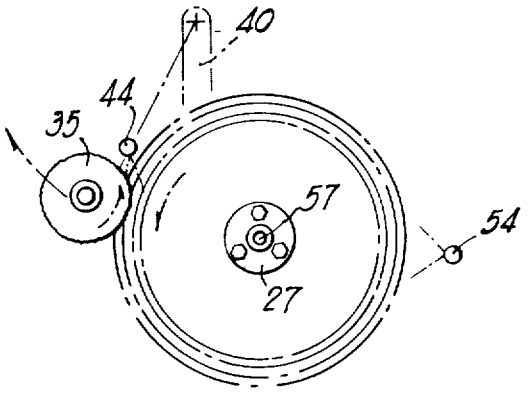
Figure 5:
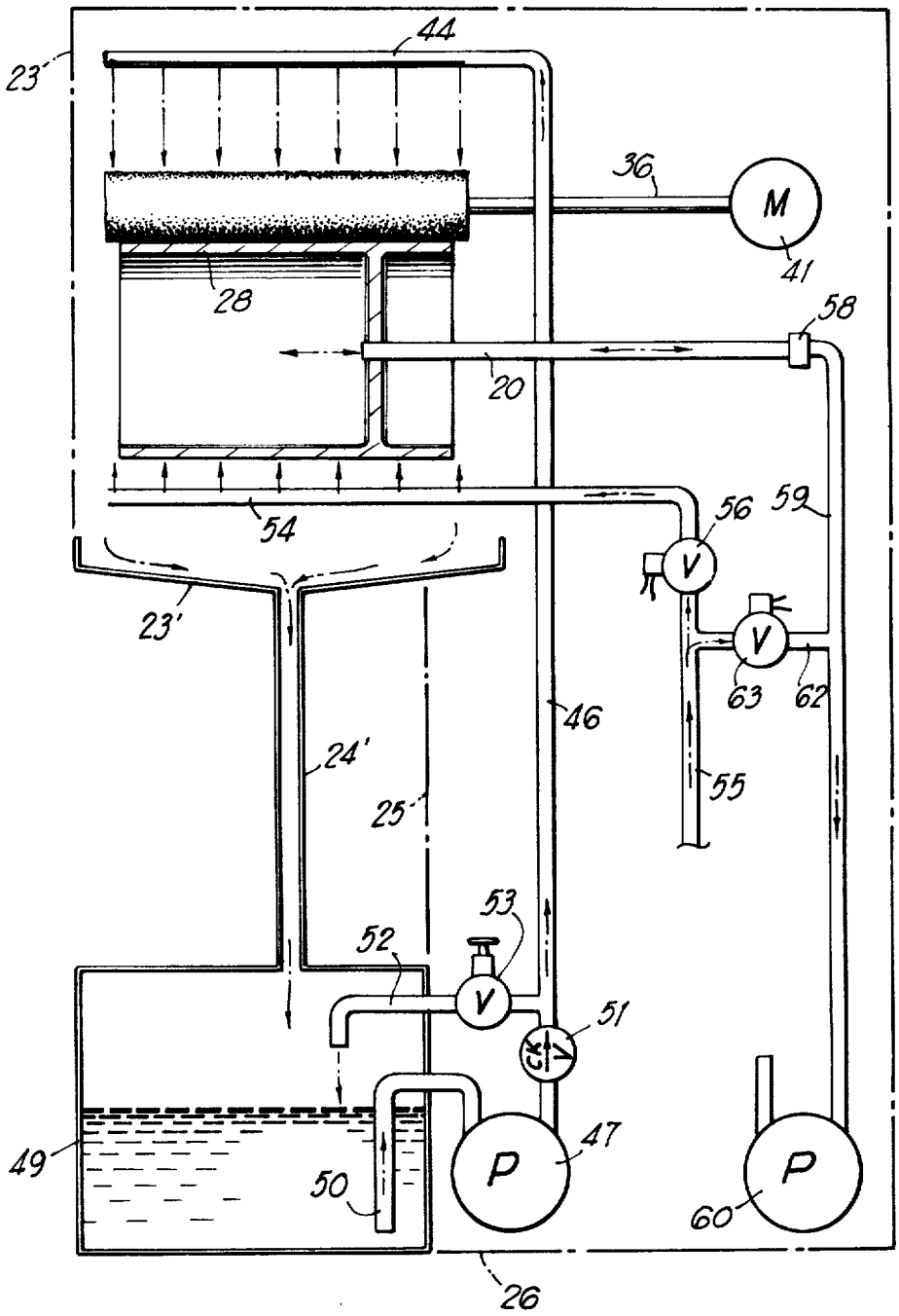
FIG. 5 is a fluid schematic of the liquid solvent and air systems employed in the pail cleaning machine.

A cleaning solvent manifold 44 extends near and parallel to the exterior of mandrel 28 in a fixed position and can have either spaced apertures or a single longitudinal slot along its length whereby the liquid solvent or cleaning solution can be sprayed onto the exterior of each pail along the full length of the pail. As shown in FIGS. 3 and 4, the solvent manifold 44 is located between the fixed axis mandrel and the pail thereon and the laterally swingable cleaning brush 35. The manifold 44 is coupled with an offset supply pipe 45 leading to a descending pipe 46, in turn connected with a liquid solvent pump 47 in the bottom section 26 of the housing. The pump has a drive motor 48 shown in FIG. 6. The pump 47 draws cleaning solvent from a supply tank 49 in the lower section of the housing through an inlet tube 50. A check valve 51 is connected in the pipe 46 between the solvent pump 47 and a bypass pipe 52 leading back into the tank 49 equipped with a bypass valve 53.

Similarly, a horizontal drying air manifold 54 parallel to the solvent manifold 44 and mandrel axis is apertured along the length of the pail 29 to dry the exterior surface of the pail at proper times when each pail has been brush-cleaned and rinsed with solvent delivered through manifold 44. The air manifold 54 is supplied with compressed air through a riser pipe 55 having connected therein a solenoid operated valve 56 and extending to a conventional plant compressed air line, not shown.

A partial vacuum at proper times is created in the interior of mandrel 28 through an air passage 57 which extends axially through the mandrel drive shaft 20, the latter being coupled through a suitable swivel fitting 58 with a vacuum supply pipe 59 descending through the housing portion 25 to the bottom of the housing where the pipe 59 is coupled to a vacuum pump 60 therein, having a drive motor 61.

Figure 6:
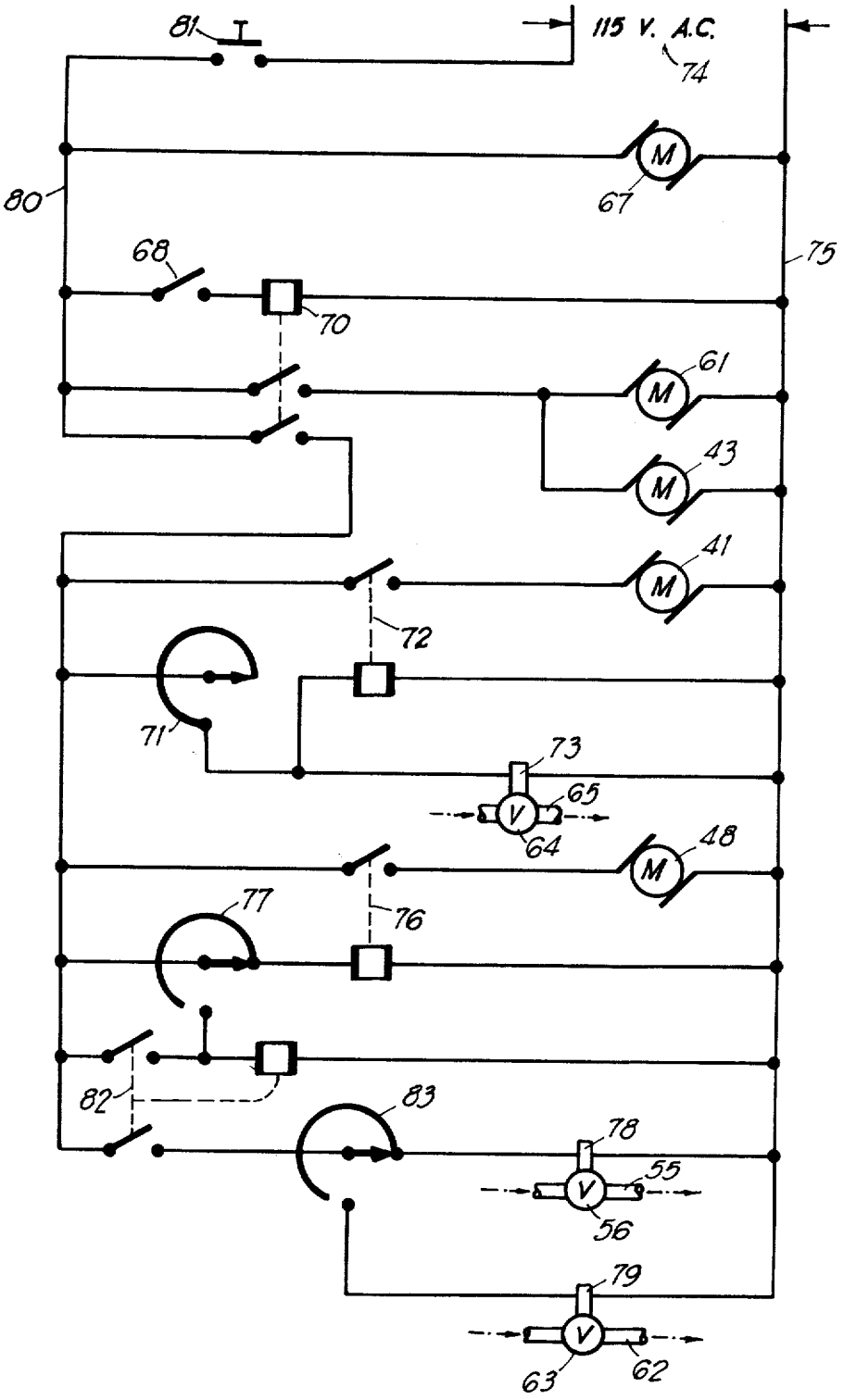
FIG. 6 is an electrical schematic showing the electrical components of the machine and their controls.

A diverter pipe 62 having a solenoid operated diverter valve 63 is connected between the two pipes 55 and 59 for a purpose to be described. Another solenoid operated valve 64, FIG. 6, is connected in the air line 65 supplying air to the air cylinder 43 which controls the movement of brush 35.

The machine has a complete pollution control system built into it including an exhaust pipe 66 for solvent fumes leading from the top housing section 24. An exhaust fan having a fan motor 67, FIG. 6, is connected in the exhaust pipe 66.

It should be mentioned that the brush 35 and mandrel 28 counter-rotate as shown by the directional arrows in FIGS. 3 and 4.

A very important feature of the invention lies in the provision of a limit switch 68 having a switch actuator 69 in the path of movement of each pail 29 as the latter is placed axially onto the mandrel 28 telescopically. Through contact with the actuator 69, the limit switch is closed to initiate a fully automatic cycle of operation to brush wash, rinse, dry and eject each pail 29 with resetting of the machine for its next operating cycle.

As shown in the drawings, the limit switch 68 is associated with the first relay 70 which is electrically connected between the limit switch and a first timer 71 connected with a second relay 72. The coil of relay 72 is electrically connected with the solenoid 73 of valve 64 which controls the supply of air to cylinder 43 for moving the brush 35 toward and away from each pail 29 on the rotating mandrel. The relay 72 is further electrically connected with brush drive motor 41 as shown in FIG. 6 while the first relay 70 is electrically connected to vacuum pump motor 61 and mandrel drive motor 43 in parallel relationship to motor 61. A standard AC power supply 74 has one terminal thereof connected through a wire 75 with the several motors 67, 61, 43, 41 and 48 and similarly connected to relays 70 and 72 and to a third relay 76 associated with another timer 77 by means of which the time of operation of solvent pump motor 48 is controlled. The power line 75 is further electrically connected to the solenoid 73 of valve 64 and to a like solenoid 78 of valve 56. These two solenoid valves, respectively, control the air supply to brush moving cylinder 43 and to drying air manifold 54. The same power line 75 leads to the solenoid 79 of valve 63 which control the diversion of compressed air from pipe 55 through pipes 62 and 59 to the center passage 57 in shaft 20 for ejecting each pail 29 from the mandrel 28 when the washing and drying cycle is completed.

The other power line 80 of power supply 74 has a main on-off switch 81 connected therein. The power line 80 is electrically connected to limit switch 68, relays 70 and 72, timer 71, relay 76, timer 77 and to a fourth relay 82 associated with a third timer 83 which is connected with the two solenoids 78 and 79, as shown. The three adjustable timers and the on-off switch 81 are mounted at a convenient elevation on one side wall of the machine housing, as shown in FIG. 1. Also mounted on this housing wall are manual adjusting knobs 84 and 85 for solvent pump 47 volumetric flow and compressed air volumetric flow through the pipe 55.

A pan 23' for solvent drippings has a descending drain pipe 24' to return such drippings to the tank 49.

OPERATION

With the three timers 71, 77 and 83 adjusted through their adjusting knobs on the housing, the power switch 81 is closed to energize the system including the exhaust fan motor 67. The first pail 29 is placed on the mandrel 28 and in so doing the pail trips the limit switch 68 by contact with the switch actuator 69. This starts vacuum motor 61 and the mandrel drive motor 43. The resulting vacuum through the line 59 and the mandrel shaft 20 holds the pail in place during rotation with the mandrel 28.

On activation, timer 71 through relay 72 starts up brush drive motor 41 and opens solenoid valve 64 to bleed air out of cylinder 43 and shift brush 35 into contact with the pail 29. Simultaneously, timer 77 through relay 76 starts solvent pump motor 48 to spray a measured amount of grease and paint solvent from manifold 44 along the entire length of the pail as it is being scrubbed by the brush.

Timer 71 completes its time interval before timer 77 and brush 35 is moved away from the pail by cylinder 43 and stops rotating before solvent pump 47 stops delivering solvent to the manifold 44. Thus, the pail is given a solvent rinse after the brush scrubbing operation terminates. On termination of the time interval for timer 77, the solvent pump motor 48 stops to end the rinse cycle.

Timer 83 is activated and this in turn energizes and opens solenoid valve 56 to deliver compressed air from pipe 55 to the apertured air drying manifold 54 so that air drying of the pail 29 will take place along its full length while the pail continues to rotate with the mandrel. At the expiration of the time period dictated by timer 83, the drying cycle ends and diverter solenoid valve 63 is energized and opened to admit compressed air from pipe 55 into pipe 59 and then through the central passage 57 of manifold drive shaft 20. This compressed air will eject the clean and dry pail 29 from the mandrel 80 and in so doing will re-open the limit switch 68 which resets the machine for a new cycle of operation, initiated by placing the next pail 29 on the mandrel 28. The entire operating cycle described above requires about twenty seconds.

FIGS. 7–10 of the drawings show an alternative embodiment of the invention for scrubbing pails 86 whose opposite ends are closed. This embodiment does not include the limit switch 68 and actuator 69. Instead, a cycle start-up push button is provided on the machine housing.

Figure 7:
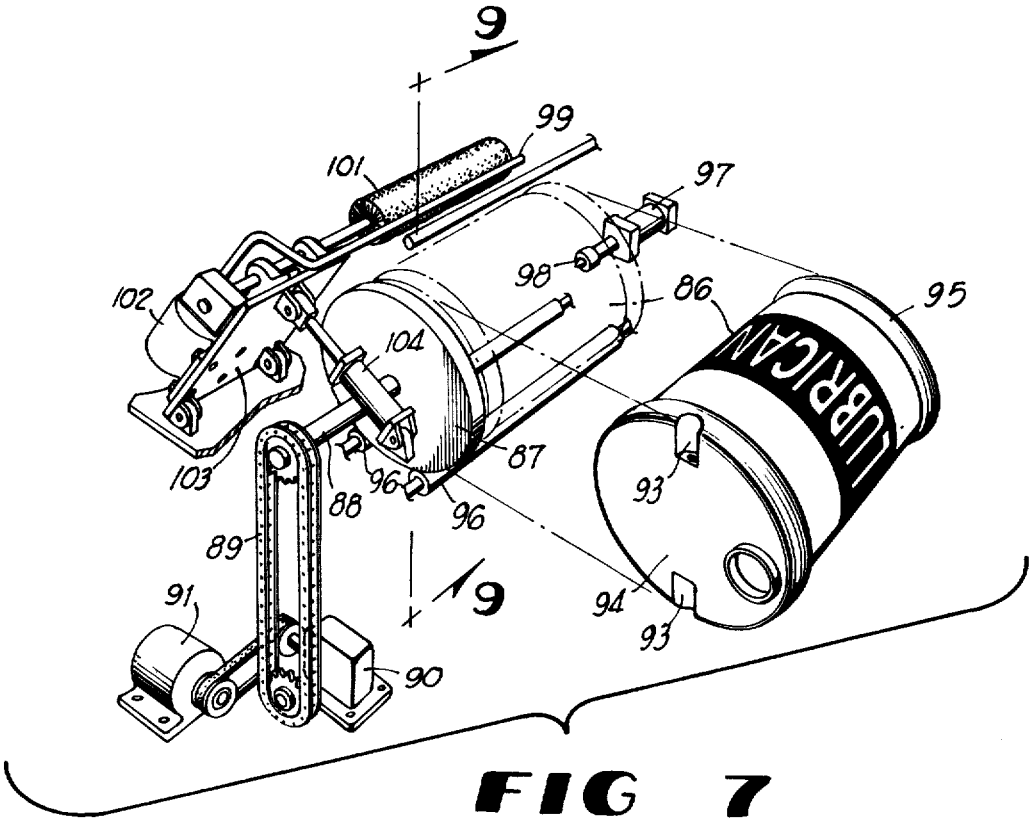
FIG. 7 is a perspective view of a pail washing machine and pail according to a modified embodiment.
Figure 8:
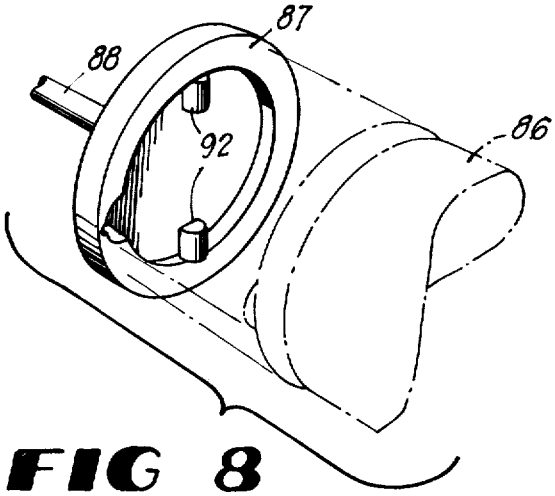
FIG. 8 is a perspective view of a pail driving head.
Figure 9:
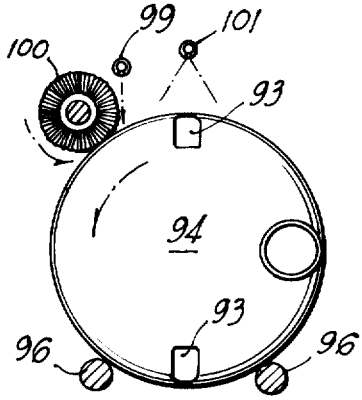
FIG. 9 is a vertical section taken on line 9—9 of FIG. 7.
Figure 10:
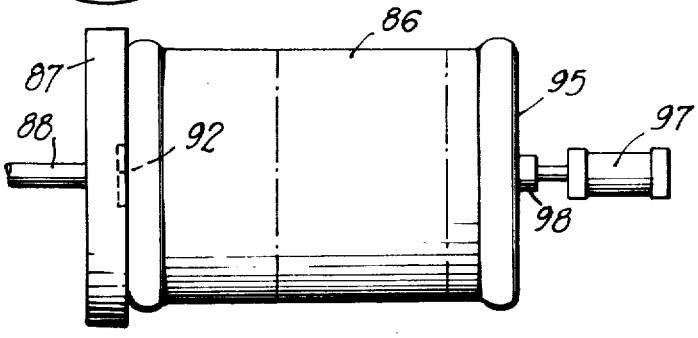
FIG. 10 is a fragmentary side elevation of the machine in FIG. 7.

In the modified embodiment, the turning mandrel 28 is not employed, and each pail 86 is side-loaded into the cleaning machine as depicted in FIG. 7 instead of being axially loaded.

Referring to FIGS. 7 through 10, a driving head or disc 87 is turned by a horizontal drive shaft 88, powered by gearing 89 including a speed reducer 90 from a drive motor 91. The driving head 87 has two projecting drive lugs 92 which enter existing recesses 93 on the end cover 94 of each pail 86, the pail having an opposite end wall 95.

Each pail is manually placed on a pair of parallel support rollers 96 which support it rotatably under the driving influence of the head 87. A small air cylinder 97 located centrally of the pail at its end away from the head 87 has its piston head 98 extended into engagement with the end wall 95 after the pail has been placed on the rollers 96, and this arrangement maintains the recesses 93 in full driven engagement with the lugs 92.

The remainder of the machine and its cycle of operation correspond exactly to the prior embodiment, and the description need not be repeated in detail, with one exception. Since the alternate embodiment does not carry a limit switch, a fourth timer (now shown) is included in the circuit to time out the operation of the mandrel drive motor 43.

A solvent manifold 99 is provided between and in parallel relationship to a scrubbing brush 100 and the pail peripheral surface. An air drying manifold 101 is positioned above the top of the rotating pail and extends along its full length. The brush 101 is powered by a motor 102 mounted on a swingable platform 103 which is shifted toward and away from the pail by a pneumatic cylinder unit 104.

The advantages of the invention already stated for the embodiment in FIGS. 1 through 6 ar also present to a major extent in the modified embodiment of FIGS. 7 to 10.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A pail washing machine comprising a frame means on said frame for supporting a pail, said pail supporting means including a mandrel having a port for air under vacuum and air under positive pressure, vacuum means connected with said mandrel port and a compressed air supply means also connected with said mandrel port whereby pails may be vacuum secured to said mandrel during said pail washing cycle and ejected therefrom by positive air pressure, means for scrubbing the exterior surface of said pail mounted on said frame for movement toward and away from a pail scrubbing position, means on said frame for delivering cleaning solvent onto said exterior surface of said pail when said pail scrubbing means is in said pail scrubbing position, and timing means electrically connected to said solvent delivering means and said pail scrubbing means for automatically operating said machine during a pail washing cycle, whereby during said cycle, solvent is directed onto the exterior surface of the pail by said solvent delivering means and said scrubbing means is moved to said pail scrubbing position wherein said scrubbing means frictionally engages the exterior surface of said pail to wash said pail.

2. A pail washing machine comprising a frame, means on said frame for supporting a pail, said pail supporting means including a horizontal roller support bed for each pail, a coacting rotary head for driving each pail on said roller support bed, and means in spaced opposed relationship to said head for engaging the end of each pail most distant from said head to force the pail into driven engagement with said head, means for scrubbing the exterior surface of said pail mounted on said frame for movement toward and away from a pail scrubbing position, means on said frame for delivering cleaning solvent onto said exterior surface of said pail when said pail scrubbing means is in said pail scrubbing position, and timing means electrically connected to said solvent delivering means and said pail scrubbing means for automatically operating said machine during a pail washing cycle, whereby during said cycle, solvent is directed onto the exterior surface of the pail by said solvent delivering means and said scrubbing means is moved to said pail scrubbing position wherein said scrubbing means frictionally engages the exterior surface of said pail to wash said pail.

3. A pail washing machine as defined in claim 1 and means for rotating said pail supporting means with said pail thereon about the longitudinal axis of said pail.

4. A pail washing machine as defined in claim 1 or 2 and said pail scrubbing means including a pail cleaning brush, means for rotating said brush about its longitudinal axis and means for moving said brush toward and away from said pail scrubbing position.

5. A pail washing machine as defined in claim 1 or 2 and said solvent delivering means including a solvent storage reservoir, a solvent manifold positioned adjacent said pail supporting means and means connected between said manifold and said reservoir for transferring solvent from said reservoir through said manifold and onto the exterior surface of said pail mounted on said pail supporting means while said pail scrubbing means is in said pail scrubbing position.

6. A pail washing machine as defined in claim 1 or 2 and means on said frame for delivering drying air onto said pail including a drying air manifold and a compressed air supply means connected with said drying air manifold.

7. A pail washing machine comprising a rotary mandrel adapted to support pails one at a time requiring washing, rotational support and driving means for the mandrel, a pail cleaning brush movably mounted near one side of the mandrel, rotational support and driving means for said brush including a movable support member, power means to move said support member for moving said brush toward and away from an active pail washing position, a cleaning solvent manifold positioned near said brush and mandrel for delivering solvent onto the latter when the brush is in said active pail washing position, pumping means for cleaning solvent connected with said manifold, a drying air manifold positioned near said mandrel in spaced relation to said mandrel and brush, compressed air supply means connected with said drying said manifold, vacuum means connected with said mandrel and including a connection with the compressed air supply means and being operable to hold each pail on said mandrel during a pail washing, rinsing and drying cycle, and timed control means for the machine including an operating cycle initiating control element activated by the placement of each pail on said mandrel.

8. A pail washing machine as defined in claim 7, and said rotational support and driving means for the mandrel including a drive shaft having an air passage therethrough, said vacuum means being connected with said air passage and including a vacuum pump, and said connection of the vacuum means with said compressed air supply means including a compressed air diverter valve, whereby positive air pressure or vacuum pressure selectively can be delivered to the mandrel through said passage of said drive shaft.

9. A pail washing machine as defined in claim 7, and said timed control means further including independent time means for the support and driving means for the brush, for the pumping means for cleaning solvent and for the compressed air supply means.

10. A pail washing machine as defined in claim 9, and said timers comprising adjustable electrical timers connected with coacting relays, a drive motor for said brush whose starting and stopping is caused by operation of the relay connected with the first-named timer, a cleaning solvent pump motor whose starting and stopping is controlled by the operation of the relay connected with the second-named timer, and a solenoid valve in the compressed air supply means whose activation is controlled by the relay connected with the third-named timer.

11. A pail washing machine as defined in claim 10, and said timed control means additionally comprising another relay, a vacuum pump motor and a mandrel drive motor electrically connected with the last-named relay and being started and stopped by opening and closing of a relay switch of the last-named relay, and said cycle initiating control element comprising a control switch having an actuator in the path of movement of each pail being placed on the mandrel, and said switch being electrically coupled to the last-named relay.

12. A pail washing machine comprising a rotational support for individual pails being washed, power drive means for said rotational support, a movable rotational washing brush parallel to the axis of the rotational support and being swingable in an arc toward and from an active washing position close to the rotational support, separate power means for driving said brush in rotation and for swinging it in said arc, a cleaning solvent manifold fixedly mounted near the rotational support and said brush and parallel to the axes of the latter and adapted to deliver cleaning solvent to the exterior of a pail on the rotational support, a drying air manifold fixedly located near the rotational support and adapted to deliver drying air to the exterior of said pail and timed control means for controlling the time of rotation of said brush and the swinging movement of the brush toward and away from said active washing position of the brush.

13. A pail washing machine as defined in claim 12, and said rotational support comprising a rotational mandrel having a port for air under vacuum and air under positive pressure whereby pails may be vacuumed secured to the mandrel and ejected therefrom by positive air pressure.

14. A pail washing machine as defined in claim 12, and said rotational support comprising a horizontal roller support bed for each pail, and a coacting horizontal axis rotary head for driving each pail on said roller support bed.

15. A pail washing machine as defined in claim 14, and said rotary driving head having spaced driving lugs thereon for entry into driving recesses existing in covers for the pails undergoing washing.

16. A pail washing machine as defined in claim 15, and said rotational support further including a power operated axial plunger device in spaced opposed relationship to said head and engaging the end of each pail most distant from the head to force the pail into driven engagement with the head.

17. A pail washing machine as defined in claim 7 or 12, and a housing for the machine at least partially enclosing said mandrel and brush, and an exhaust conduit for solvent fumes and particles connected in and leading from a wall of said housing.

18. A pail washing machine comprising a substantially horizontal axis rotary mandrel adapted to hold a pail during a pail washing, rinsing and air drying automatic cycle, power means to rotate the mandrel, valved means to selectively deliver vacuum or positive pressure to the mandrel for vacuum holding each pail thereon and for ejecting each pail at the completion of said automatic cycle, a parallel axis laterally movable rotary pail washing implement near one side of the mandrel for washing the exterior of each pail thereon, power means to drive said washing implement in rotation oppositely to the direction of rotation of the mandrel, power means to move the rotary washing implement toward and away from an active pail washing position relative to the mandrel, means to deliver a pail washing liquid onto the exterior of each pail on the mandrel along the full length of the pail, means to deliver drying air to the exterior of each pail on the mandrel along the entire length of the mandrel, and an automatic cycle initiating and terminating control element near the mandrel operated by placement of each pail on the mandrel and removal of each pail from the mandrel.

19. A pail washing machine as defined in claim 18, and an automatic cycle control circuit including said control element and further including timer means to regulate movements of said washing implement and the activation and de-activation of the means to deliver pail washing liquid and drying air.

* * * * *